US006073442A

United States Patent [19]

Creger et al.

[11] Patent Number: 6,073,442

[45] Date of Patent: Jun. 13, 2000

[54] APPARATUS AND METHOD FOR CONTROLLING A VARIABLE DISPLACEMENT PUMP

[75] Inventors: Todd D. Creger, Metamora; Hans P. Dietz, Naperville, both of Ill.

[73] Assignee: Caterpillar Inc., Peoria, Ill.

[21] Appl. No.: 09/065,273

[22] Filed: Apr. 23, 1998

[51] Int. Cl.[7] ..... F16D 31/02

[52] U.S. Cl. ..... 60/446; 60/329; 60/449

[58] Field of Search ..... 60/327, 446, 449

[56] References Cited

U.S. PATENT DOCUMENTS

| | | | |
|---|---|---|---|
| 4,655,689 | 4/1987 | Westveer et al. | 417/53 |
| 4,823,552 | 4/1989 | Ezell et al. | 60/443 |
| 5,190,445 | 3/1993 | Ikari | 417/218 |
| 5,214,916 | 6/1993 | Lukich | 60/431 |
| 5,218,895 | 6/1993 | Lukich et al. | 91/361 |
| 5,249,421 | 10/1993 | Lunzman | 60/422 |
| 5,267,441 | 12/1993 | Devier et al. | 60/452 |
| 5,305,681 | 4/1994 | Devier et al. | 91/361 |
| 5,468,126 | 11/1995 | Lukich | 417/53 |
| 5,490,384 | 2/1996 | Lunzman | 60/327 |
| 5,525,043 | 6/1996 | Lukich | 417/218 |
| 5,540,049 | 7/1996 | Lunzman | 60/327 |
| 5,680,760 | 10/1997 | Lunzman | 60/426 |

FOREIGN PATENT DOCUMENTS

| | | |
|---|---|---|
| 0539589A1 | 5/1993 | European Pat. Off. . |
| 0715031A2 | 6/1996 | European Pat. Off. . |
| 0765970A2 | 4/1997 | European Pat. Off. . |
| 0796952A1 | 9/1997 | European Pat. Off. . |
| 0812964A1 | 12/1997 | European Pat. Off. . |

*Primary Examiner*—Edward K. Look
*Assistant Examiner*—Hermes Rodriguez
*Attorney, Agent, or Firm*—David M. Masterson; Byron G. Buck

[57] ABSTRACT

A method for controlling the displacement of a variable displacement hydraulic pump to produce a desired flow of fluid is disclosed. The method includes the steps of: determining that the machine is being operated in a digging cycle; determining a desired displacement of the pump, the desired pump displacement being less than the maximum pump displacement; and controlling the pump displacement to the desired pump displacement to produce a desired flow of fluid.

8 Claims, 5 Drawing Sheets

18
305
310
315
24
12
17
30
38
DIGGING?
PUMP DISPLACEMENT
LEVER OVERIDE?
PC
VALVES
TRANS. SIGNAL
TRAVEL SIGNAL
CYL.POS.SIGNAL
LIFT SIGNAL
TILT SIGNAL

APPARATUS AND METHOD FOR CONTROLLING A VARIABLE DISPLACEMENT PUMP

TECHNICAL FIELD

This invention relates generally to a method and apparatus for controlling the displacement of an variable displacement pump, and more particularly, to a method and apparatus for controlling the displacement of an variable displacement pump in response to a work cycle of an earth working machine.

BACKGROUND ART

Currently, earth working machines, such as wheel loaders, use fixed displacement pumps to control fluid flow to hydraulic cylinders that actuate a work implement of the earth working machine. Under certain work cycles, such as a digging cycle, a fixed displacement pump may provide more flow than the cylinders can use. Consequently, the fluid flow that is not being used by the cylinders is diverted to tank through either a spool bypass valve or a relief valve. Unfortunately, the fluid flow that is returned to tank is not used to perform any useful work.

The present invention is directed toward overcoming one or more of the problems as set forth above.

DISCLOSURE OF THE INVENTION

In one aspect of the present invention, a method for controlling the displacement of a variable displacement hydraulic pump to produce a desired flow of fluid is disclosed. The method includes the steps of: determining that the machine is being operated in a digging cycle; determining a desired displacement of the pump, the desired pump displacement being less than the maximum pump displacement; and controlling the pump displacement to the desired pump displacement to produce a desired flow of fluid.

BRIEF DESCRIPTION OF THE DRAWINGS

For a better understanding of the present invention, reference may be made to the accompanying drawings in which.

BEST MODE FOR CARRYING OUT THE INVENTION

Figure 1:
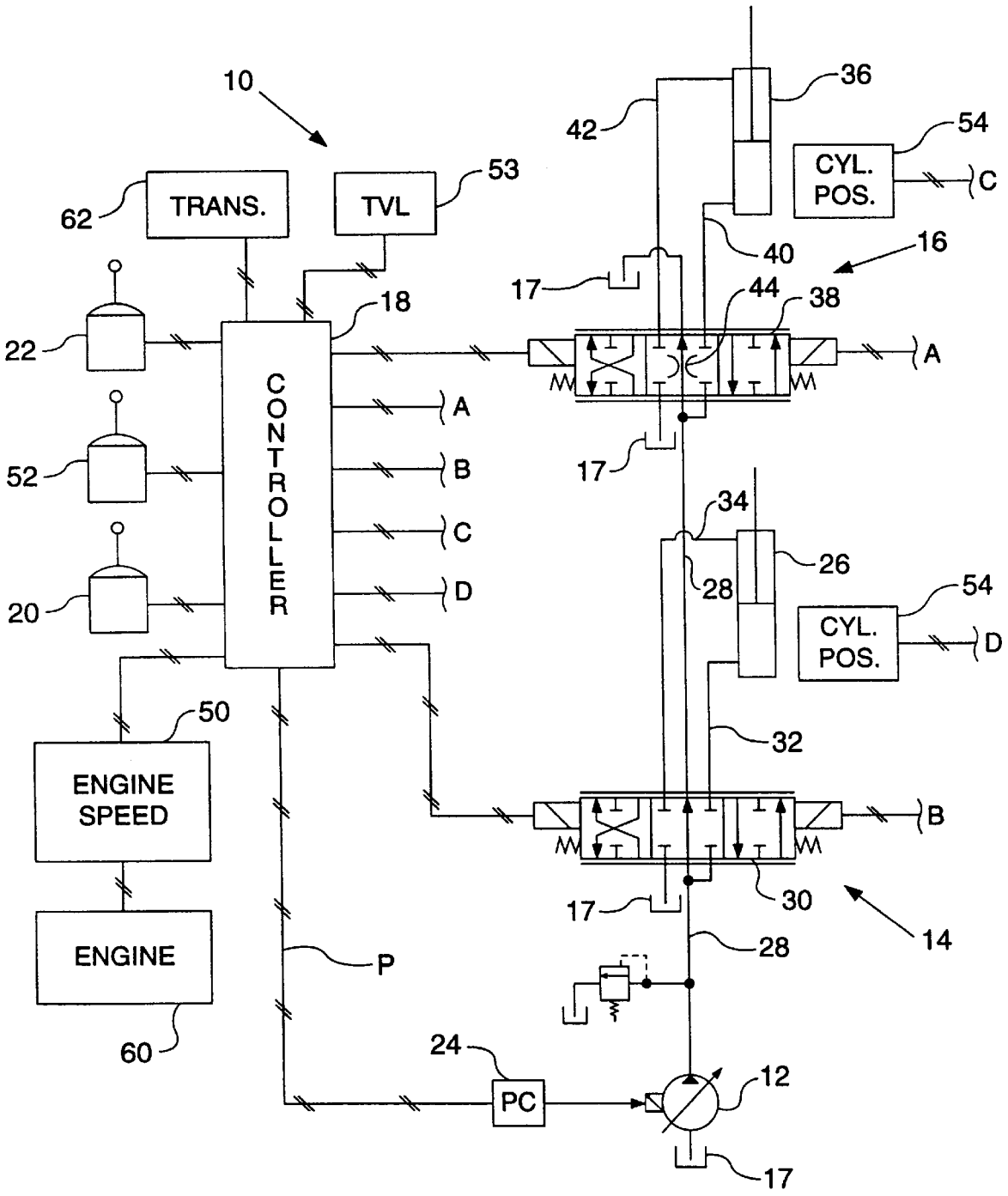
FIG. 1 illustrates a hydraulic system of an earth working machine.

Referring to the drawings and more specifically to FIG. 1, a hydraulic system 10 of an earth working machine, such as a wheel loader, is illustrated. The hydraulic system includes a source of pressurized fluid, such as a variable displacement hydraulic pump 12, first and second fluid circuits 14,16, a reservoir 17, an electronic controller 18, and lift and tilt levers 20,22.

The hydraulic pump 12 is operative from a minimum displacement position towards a maximum displacement position and is controlled by a displacement controller 24. The pump displacement controller 24 is responsive to receipt of a displacement command signal from the electronic controller 18.

The first fluid circuit 14 includes a lift cylinder 26 operative to receive fluid from the hydraulic pump 12 through a supply conduit 28 and a first open-centered control valve 30. The lift cylinder 26 is connected to the first open-centered control valve 30 by conduits 32,34. The first open-centered control valve 30 is an electrically controlled proportional valve that is movable from a spring biased, neutral position towards first and second operative positions in response to receipt of flow command signals from the electronic controller 18.

At the neutral position of the first open-centered control valve 30, the fluid flow from the hydraulic pump 12 is blocked from the lift cylinder 26 and is freely passed to the second fluid circuit 16 by the supply conduit 28. At the first and second operative positions, the fluid flow from the hydraulic pump 12 is in fluid communication with the lift cylinder 26 through the appropriate conduit 32,34 and the free flow through the control valve 30 to the downstream second circuit 16 is blocked. Whenever the control valve 30 is being operated between the neutral position and one of its first and second operative positions, a portion of the fluid flow from the hydraulic pump 12 is passed to the downstream second circuit 16.

The second fluid circuit 16 includes a tilt cylinder 36 operative to receive fluid from the first fluid circuit 14 through the supply conduit 28 and a second open-centered control valve 38. The tilt cylinder 36 is connected to the second open-centered control valve 38 by conduits 40,42. The second open-centered control valve 38 is also an electrically controlled proportional valve that is movable from a spring biased, neutral position towards first and second operative positions in response to receipt of flow command signals from the electronic controller 18.

At the neutral position of the second open-centered control valve 38, the fluid flow from the supply conduit 28 is blocked from the tilt cylinder 36 and the flow to the reservoir 17 is controllably restricted by a restriction 44. In the first and second operative positions, the fluid flow from the first fluid circuit 14 through the supply conduit 28 is in fluid communication with the tilt cylinder 36 through the appropriate conduit 40,42 and the restricted flow through the second control valve 38 to the reservoir 17 is blocked. During an initial portion of the second control valve 38 being operated within one of its first and second operative positions, fluid limited flow is permitted through the restriction 44 to the reservoir 17. Thereafter, fluid flow through the restriction is blocked.

The electronic controller 18 receives lift and tilt control signals from the respective lift and tilt levers 20,22. The electronic controller 18 processes the signals and delivers the respective command signals to the pump displacement controller 24 and to the appropriate control valve 30,38. In response to receiving the flow command signal, the displacement of the hydraulic pump 12 is moved to a position to provide an appropriate amount of fluid flow that is needed to satisfy the inputs requested through the lift and tilt levers 20,22. Likewise, in response to receiving the flow command signals, the first and second open-centered control valves 30,38 are moved to the appropriate position to direct a fluid volume to the associated actuator 26/36 as required by the control signal generated by the respective lift and tilt levers 20,22.

The electronic controller automatically receives several signals pertaining to the operation of the machine power train (not shown) which includes the machine engine 60 and transmission 62. An engine speed sensor 50 produces an engine speed signal that is responsive to the flywheel rotation of the engine 60. A transmission control lever 52 is included for selectively controlling the operation of the transmission 62. The transmission control lever 52 generates transmission control signals to the electronic controller 18 that is indicative of a desired gear ratio and/or direction of the machine. A travel speed sensor 53 produces a machine travel speed signal that is responsive to the transmission output speed.

The electronic controller 18 may receive position signals produced by position sensors 54 that indicate the position of the lift and tilt cylinders 26,36. For example, the position sensors 54 may include displacement sensors that sense the amount of cylinder extension in the lift and tilt hydraulic cylinders respectively. Such position signals are indicative of the position of the machine work implement 107 shown on FIG. 2. The work implement 107 position may also be derivable from the work implement joint angle measurements. Thus, an alternative device for producing the position signals include rotational angle sensors such as rotatory potentiometers, for example, which measure the rotation of one of the lift arm pivot pins from which the geometry of the lift arm assembly or the extension of the lift cylinders can be derived. The work implement position may be computed from either the hydraulic cylinder extension measurements or the joint angle measurement by trigonometric methods.

Figure 2:
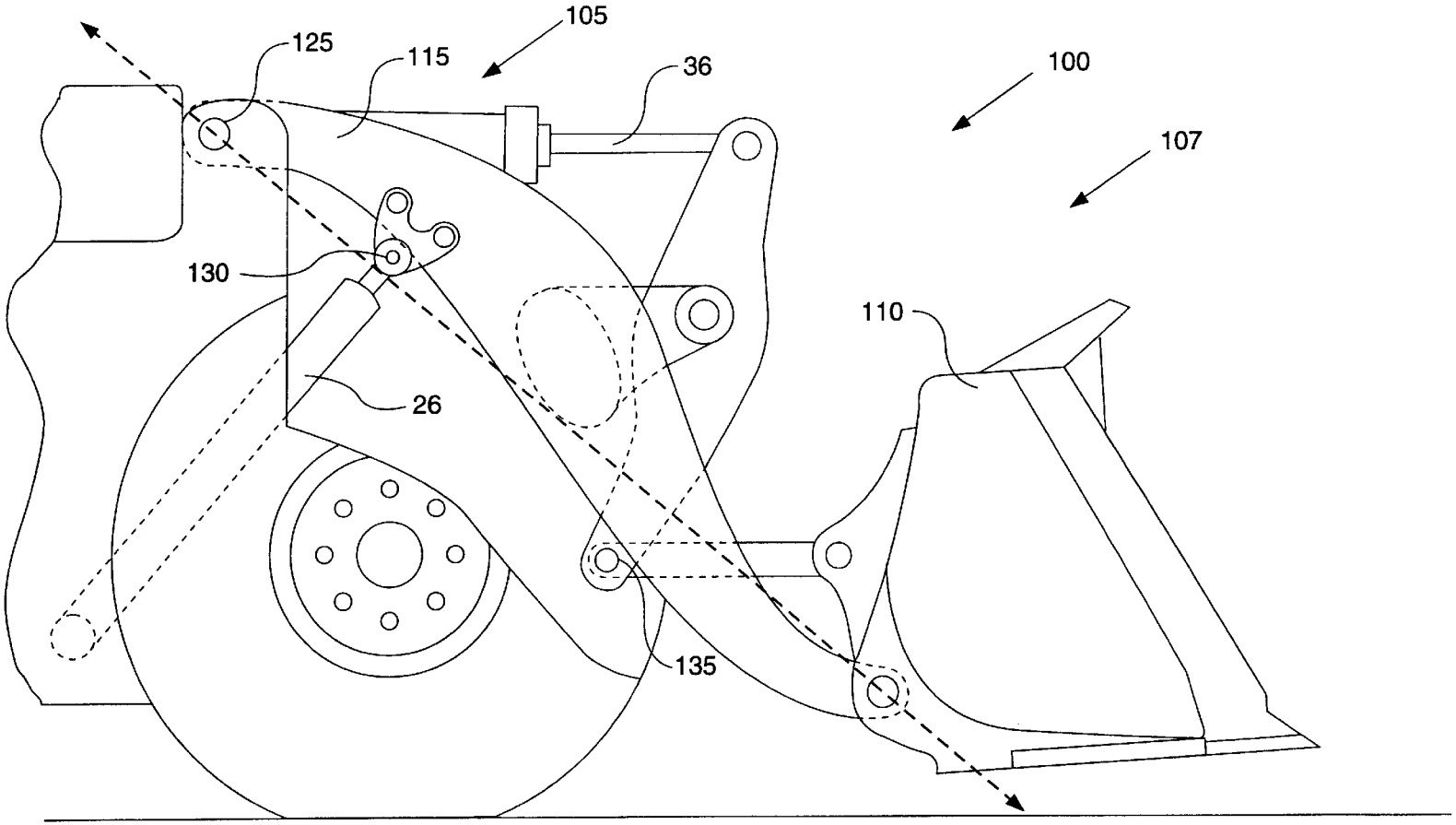
FIG. 2 illustrates a forward portion of the earth working machine.

The earth working machine 100 is shown with more particularity with reference to FIG. 2, where a forward portion 105 of a wheel-type loader having a work implement 107 is illustrated. Note that the illustrated wheel loader is just one example of an earth working machine. The work implement 107 includes a bucket 110 that is connected to a lift arm assembly or linkage 115 that is pivotally actuated by two hydraulic lift cylinders 26 (only one of which is shown) about a pair of lift arm pivot pins 125 (only one shown) attached to the machine frame. A pair of lift arm load bearing pivot pins 130 (only one shown) are attached to the lift arm assembly and the lift cylinders. The bucket is also tilted or racked by a bucket tilt cylinder 36 about a pair of bucket pivot pins 135 (only one shown).

The present invention is embodied in a microprocessor based system which utilizes arithmetic units to control process according to software programs. Typically, the programs are stored in read-only memory, random-access memory or the like. The programs are discussed in relation to various block diagrams.

Figure 3:
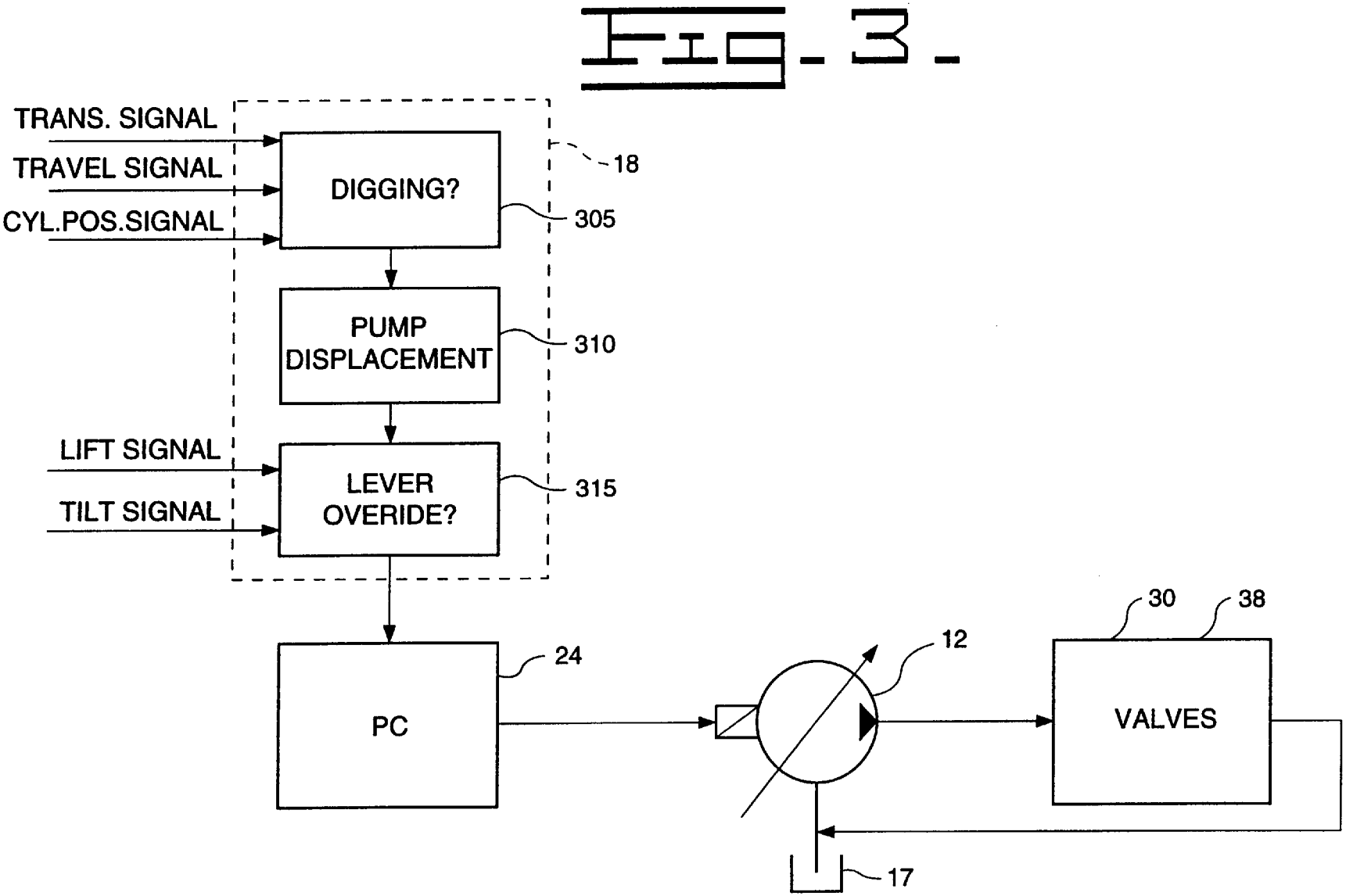
FIG. 3 illustrates a block diagram of one embodiment of a control system for regulating the displacement of a variable displacement pump of the hydraulic system.

Reference is now made to one embodiment of the present invention which is illustrated in FIG. 3. The present invention provides for a control strategy that reduces the excess flow capacity of the hydraulic system 10 during digging operations by reducing pump displacement by a predetermined amount. For the purposes of the present invention, the electronic controller 18 determines when the earth working machine is operating in a digging cycle in response to the following three conditions:

1) the operator has selected the first gear forward shift position representing a first gear forward gear ratio of the transmission;
2) the work implement is at a digging position; and
3) the machine travel speed is less than a predetermined amount.

One method for determining whether the work implement is at a digging position is by measuring the lift cylinder position to determine whether the lift linkage is at an altitude that is equal to or less than a horizontal reference line. For example, such a horizontal reference line may be defined by the lift arm pivot pin 125 and the bucket pivot pin 135, which is shown in phantom in FIG. 2.

This aspect of determining whether the machine is operating in a digging cycle is represented by block 305 of FIG. 3. Once the electronic controller 18 has determined that the machine is digging, the controller determines an appropriate pump displacement, represented by block 310 of FIG. 3, in response to the following equation:

$$DISP_{DESIRED}=\alpha\times DISP_{MAX}$$

where $DISP_{MAX}$ is the maximum displacement of the pump 12;

where $\alpha$ represents a pump displacement multiplier which is preferably between the values of 0.5 and 1.0; and where $DISP_{DESIRED}$ is the desired displacement of the pump 12.

Once the electronic controller 18 has determined the desired pump displacement, the controller then determines whether a lever override condition exists represented by block 315 of FIG. 3. For the purposes of the present invention, a lever override condition exists when the sum of the lift and tilt lever angles, represented by the lift and tilt control signals, exceeds a predetermined value, or whether the angle of the respective lift and tilt levers independently exceeds a predetermined value. In response to a lever override conditioning existing, the desired pump displacement defaults to the maximum displacement.

In response to determining the desired pump displacement, the electronic controller 18 produces a pump displacement command signal to the pump control 24, which in turn, controls the pump displacement of the variable displacement pump 12 to produce the desired flow of fluid.

Additional embodiments of the present invention will now be described. The same elements as those of the first embodiment will be given the same numerals and the explanation thereof will be omitted.

Figure 4:
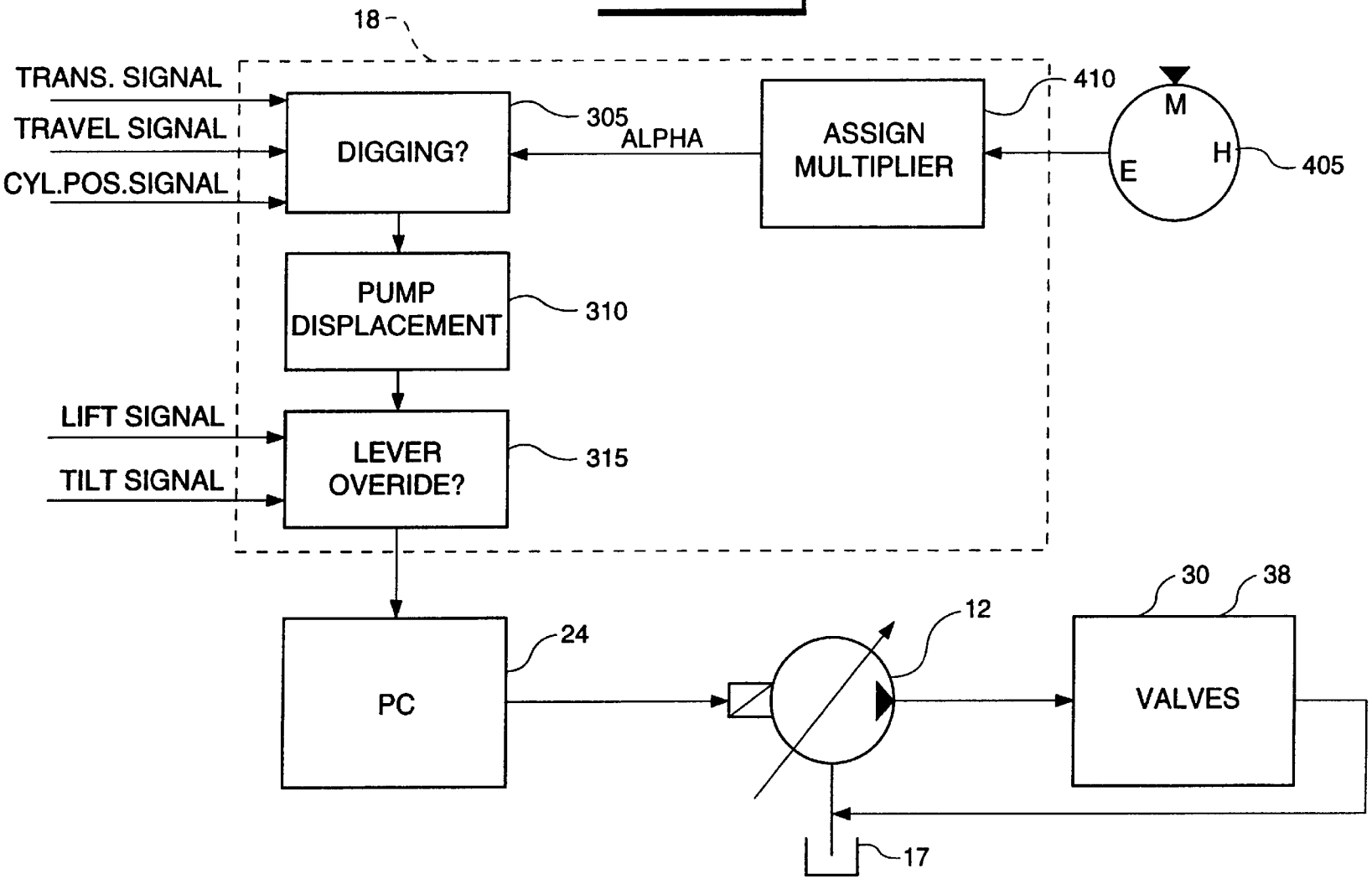
FIG. 4 illustrates a block diagram of another embodiment of a control system for regulating the displacement of the variable displacement pump of the hydraulic system.

Another embodiment of the present invention is illustrated in FIG. 4. The embodiment of FIG. 4 utilizes an operator dial 405 that is used to specify an upper limit on pump displacement. The operator dial 405 provides the operator with the ability to specify the limit on pump displacement by specifying the condition of the soil that is to be worked by the machine. For example, the operator dial 405 may include a three position rotary switch labeled Easy Material, Moderate Material, and Hard Material, where each particular setting of the dial corresponds to a unique pump displacement multiplier $\alpha$. Once the operator positions the operator dial 405, then the electronic controller 18 responsively determines the corresponding pump displacement multiplier $\alpha$. For example, in the illustrated embodiment, the controller 18 selects a pump displacement multiplier $\alpha$ of 0.85 for Easy Material, 0.75 for Moderate Material, and 0.60 for Hard Material from a look-up table. Once the pump displacement is multiplier $\alpha$ is determined, then the controller 18 determines the desired pump displacement as described in the prior embodiment.

Figure 5:
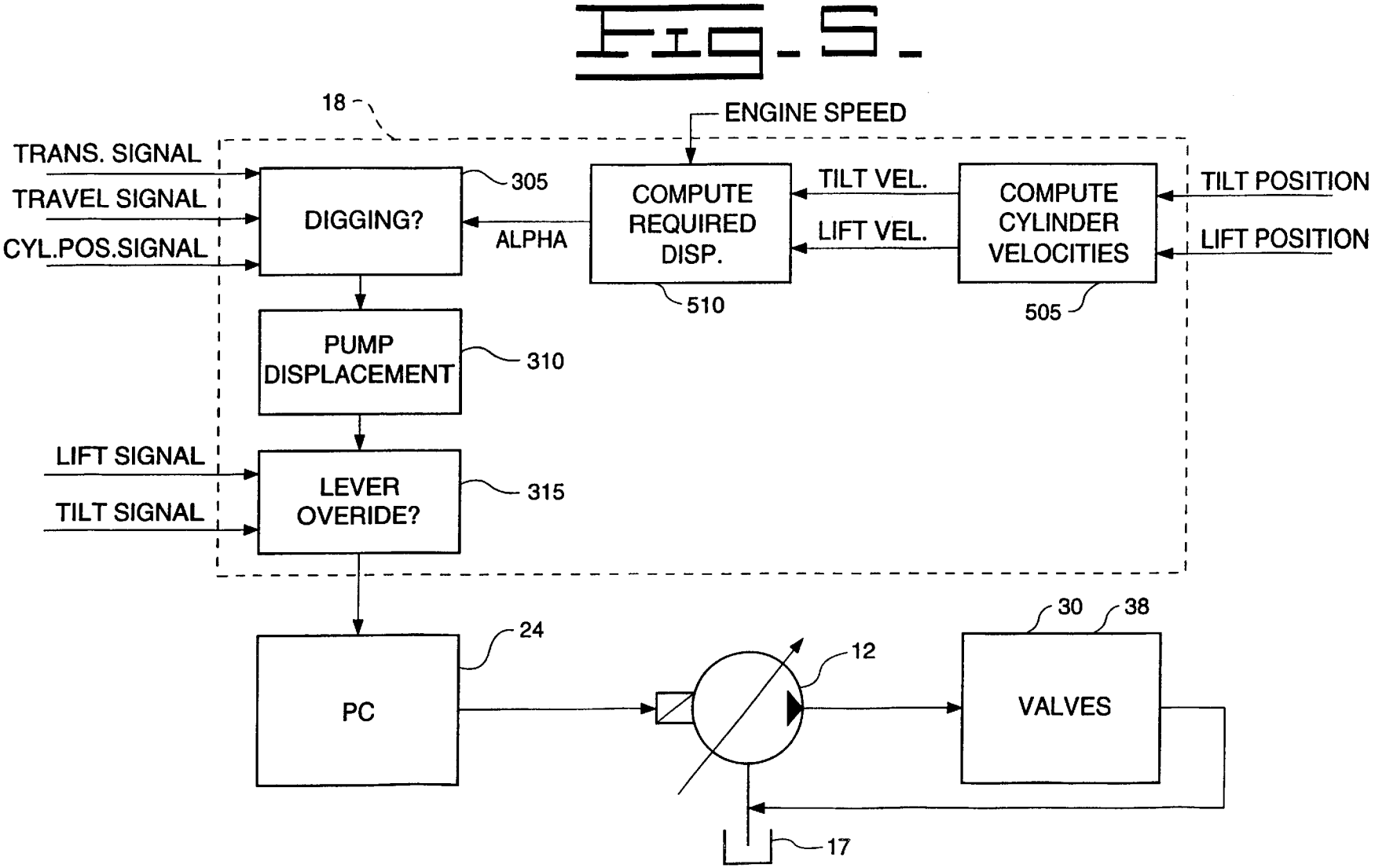
FIG. 5 illustrates a block diagram of yet another embodiment of a control system for regulating the displacement of the variable displacement pump of the hydraulic system.

Reference is now made to yet another embodiment of the present invention illustrated in FIG. 5. As indicated by block 505, the electronic controller 18 determines the velocities of each cylinder, for example, in response to differentiating the position signals that represent the position of the tilt and lift cylinders 26,37. The determined tilt and lift cylinder velocities represent the fluid flow utilization of the respective cylinders. Once the tilt and lift cylinder velocities have been determined, then the controller 18 determines the required pump displacement, as represented by block 510. The required pump displacement is determined by the following equations:

$$FLOW=VEL_{CYLINDER}\times AREA_{CYLINDER}$$

$$DISP_{REQUIRED}=FLOW/SPEED_{PUMP}$$

$$\alpha=DISP_{REQUIRED}/DISP_{MAX}$$

$$DISP_{DESIRED}=\alpha\times DISP_{MAX}$$

where $VEL_{CYLINDER}$ is determined in response to differentiating the position signals;

where $AREA_{CYLINDER}$ is predetermined;

where $SPEED_{PUMP}$ is derived from the speed of the engine;

where $DISP_{REQUIRED}$ is the required displacement of the pump 12;

where $DISP_{MAX}$ is the maximum displacement of the pump 12;

where $\alpha$ represents the pump displacement multiplier; and where $DISP_{DESIRED}$ is the desired displacement of the pump 12.

In response to determining the desired pump displacement, the electronic controller 18 produces a pump displacement command signal to the pump control 24 which in turn controls the pump displacement of the variable displacement pump 12 to produce the desired fluid pressure.

Thus, while the present invention has been particularly shown and described with reference to the embodiments described above, it will be understood by those skilled in the art that various additional embodiments may be contemplated without departing from the spirit and scope of the present invention.

Industrial Applicability

The present invention provides for a method that automatically determines a desired hydraulic pump displacement to allow the majority of fluid flow produced by the pump to perform productive work. As described, the present invention provides for a method and apparatus for determining when an earth working implement is performing a digging operation, and responsively reducing the displacement of a variable displacement pump to result a desired flow of fluid that allows a higher percentage of fluid flow to be applied to the hydraulic cylinders to perform work. This prevents fluid flow from being wasted by returning the flow directly to tank.

Other aspects, objects and advantages of the present invention can be obtained from a study of the drawings, the disclosure and the appended claims.

What is claimed is:

1. A method for controlling the displacement of a variable displacement hydraulic pump to deliver a desired flow of fluid to a hydraulic cylinder for actuating a work implement of a work machine having a transmission comprising the steps of:

determining that the machine is being operated in a digging cycle by at least one of the steps of:

determining that the transmission is engaged in a first gear forward gear ratio;

determining that the work implement is engaged in a digging position; and determining that the travel speed of the machine is less than a predetermined amount;

determining a desired displacement of the pump, the desired pump displacement being less than the maximum pump displacement; and controlling the pump displacement to the desired pump displacement to produce a desired flow of fluid.

2. A method, as set forth in claim 1, wherein the desired pump displacement is determined in accordance with the following equation:

$$DISP_{DESIRED}=\alpha\times DISP_{MAX}$$

where $DISP_{MAX}$ is the maximum displacement of the pump;

where $\alpha$ represents a pump displacement multiplier; and where $DISP_{DESIRED}$ is the desired displacement of the pump.

3. A method, as set forth in claim 1, wherein the machine includes an operator dial for selecting a desired pump displacement by specifying the condition of the soil that is to be worked by the machine, and including the step of determining the desired pump displacement in response to the operator dial setting.

4. A method, as set forth in claim 3, including the steps of:

determining the velocity of the hydraulic cylinder;

determining the speed of the engine; and determining the desired pump displacement in response to the cylinder velocity and engine speed.

5. An apparatus for controlling the displacement of a variable displacement hydraulic pump to deliver a desired flow of fluid to a hydraulic cylinder for actuating a work implement of a work machine having a transmission, comprising:

means for determining that the machine is being operated in a digging cycle by at least one of:

determining that the transmission is engaged in a first gear forward gear ratio;

determining that the work implement is engaged in a digging position; and determining that the travel speed of the machine is less than a predetermined amount;

means for determining a desired displacement of the pump, the desired pump displacement being less than the maximum pump displacement; and means for controlling the pump displacement to the desired pump displacement to produce a desired flow of fluid.

6. An apparatus, as set forth in claim 5, including an operator dial for selecting a desired pump displacement by specifying the condition of the soil that is to be worked by the machine, wherein the desired pump displacement is determined in response to the operator dial setting.

7. An apparatus, as set forth in claim 6, including:

a position sensor for producing a position signal that is indicative of the position of the cylinder;

means for receiving the position signal, differentiating the position signal, and producing a velocity signal indicative of the velocity of the movement of the cylinder; and an engine speed sensor for producing an engine speed signal that is indicative of the speed of the engine.

8. An apparatus, as set forth in claim 7, including means for determining the desired pump displacement in response to the cylinder velocity and engine speed signals.

* * * * *